United States Patent [19]

Hagen et al.

[11] 4,416,630

[45] Nov. 22, 1983

[54] WEAPONS EFFECT SIGNATURE SIMULATOR

[75] Inventors: James M. Hagen, Riverside; James D. King, Sierra Madre, both of Calif.

[73] Assignee: The United States of America as represented by the Secretary of the Navy, Washington, D.C.

[21] Appl. No.: 344,859

[22] Filed: Feb. 1, 1982

[51] Int. Cl.[3] ..... F42D 7/00; F41F 27/00

[52] U.S. Cl. ..... 434/16; 434/21; 42/1 A; 42/1 D

[58] Field of Search ..... 434/16, 18, 17, 11, 434/12; 102/334, 336, 370, 443, 530; 124/32, 54; 42/1 A, 1 D

[56] References Cited

U.S. PATENT DOCUMENTS

| | | | |
|---|---|---|---|
| 3,024,453 | 3/1962 | Ransom | 42/1 A |
| 3,062,144 | 11/1962 | Hori et al. | 102/336 |
| 3,334,425 | 8/1967 | Ohlund | 434/16 |
| 3,466,761 | 9/1969 | Stinchcomb | 434/22 |
| 3,672,301 | 6/1972 | Abbott | 102/530 |
| 3,818,834 | 6/1974 | Baumgartener | 102/530 |
| 4,227,460 | 10/1980 | Krone et al. | 102/334 |

*Primary Examiner*—Vance Y. Hum
*Assistant Examiner*—Leo P. Picard
*Attorney, Agent, or Firm*—Robert F. Beers; Thomas M. Phillips

[57] ABSTRACT

A realistic audio-visual effects generator for simulating anti-tank and anti-aircraft missile launching. A pyrotechnic cartridge having disc at one end that ruptures and allows the efflux of the products of combustion to exit through a hole in the breech block which is placed at the muzzle end of the firing chamber. Along with the simulated cartridge discharge is electrical circuitry for determining if the cartridge has been properly chambered.

The circuitry acts to prohibit firing should it be determined that incorrect installation has occurred. Upon initiation of firing a conventional laser transmitter is actuated for simulating firing of the weapon.

7 Claims, 4 Drawing Figures

WEAPONS EFFECT SIGNATURE SIMULATOR

BACKGROUND OF THE INVENTION

This invention relates generally to military field training systems and more particularly to such systems that involve observation of the simulated launching of a rocket propelled missile or projectile.

In recent times military field training systems have been devised which utilize invisible laser beams to simulate the flight of a bullet, missile, or other projectile. Detectors located on men and vehicles detect the presence of the laser beams to indicate the hits and near misses. In this fashion, non-lethal two-sided training exercises may be conducted.

It is desirable in the conduct of these exercises to include also the sight and sound effects by which soldiers ordinarily are made aware of an attack and by which they may locate the source in order to take evasive action or initiate a counterattack.

The audio-visual effects associated with the launching of rocket powered anti-tank or anti-aircraft missiles are especially important in this context. Not only do these effects differ in character from the audio-visual effect of gunfire, but the flight time of the missile is long enough to permit evasion or effective counteraction if its launch is promptly recognized. Training of troops to recognize and react properly and quickly to such events is an important goal of the training exercises.

In the past, various devices and mechanisms have been exploited for the production of the sound, smoke puff, and visual flash of a missile launch. Generally, these devices have been single type missile simulators and have not required the operator to adhere to the operating sequence and precautions of the weapon simulated. It is the purpose of this invention to overcome these defects and provide a realistic audio-visual effects generator for simulating anti-tank and anti-aircraft missile launchings. It is further the purpose of this invention to provide such a simulator in a size and form suitable for incorporation into several field use weapon system simulators.

SUMMARY OF THE INVENTION

The new approach to audio-visual simulation of missile launch effects is the use of a dual chambered pyrotechnic cartridge fired in a uniquely configured mechanism. The mechanism uses a combination of electrical circuitry and a conventional hammer, sear, and firing pin to initiate cartridge action. Electrical circuitry includes interactive components which inhibit the action of laser transmitters simulating missile trajectories such that flight of the missile is not simulated unless audio-visual effects are first produced.

More specifically, the invention consist of a firing chamber in which the conventional configuration of breech block, muzzle, and firing pin is rearranged so that the breech block is placed at the muzzle end of the chamber. The (conventional) breech end of the chamber is closed except for a small hole through which a firing pin may penetrate. The muzzle end of the chamber provides a shoulder for seating and aligning a cartridge which is retained in position by a breech block or door. A hole through the breech block of smaller diameter than the cartridge permits the efflux of the products of combustion when the cartridge is fired while retaining the cartridge body itself. The breech block also contains electrical contacts to the cartridge closure. It is therefore an object of the invention to provide a new method of providing audio and visual effects simulating those of a large class of missile launchings.

Is is another object of the invention to provide a pyrotechnic capable of simulating the audio and visual effects of missile launches.

It is a further object of the invention to provide a firing mechanism that activates a pyrotechnic cartridge simulating the audio and visual effects of missile launches.

It is a still further object of the invention to provide a mechanism by which the functioning of ancilliary devices is denied unless a functional pyrotechnic cartridge is properly installed in a firing mechanism and by which the functioning of the ancilliary devices is again denied by the discharge of the pyrotechnic.

It is yet another object of the invention to provide an overall audio-visual effects simulation mechanism which is compatable in size, weight, and electrical characteristics with weapon simulators used in battlefield training.

Other objects, advantages and novel features of the invention will become apparent from the following detailed description of the invention when considered in conjunction with the accompanying drawings wherein:

FIG. 1 is a functional block diagram of a system utilizing the invention; and FIG. 2 is perspective view, partly in section, of the pyrotechnic cartridge of FIG. 1; and FIG. 3 is a perspective view of the assembled apparatus with the cartridge removed; and FIG. 4 is a schematic diagram of the firing circuit of FIG. 1.

DETAILED DESCRIPTION OF THE PREFERRED EMBODIMENT

Figure 1:
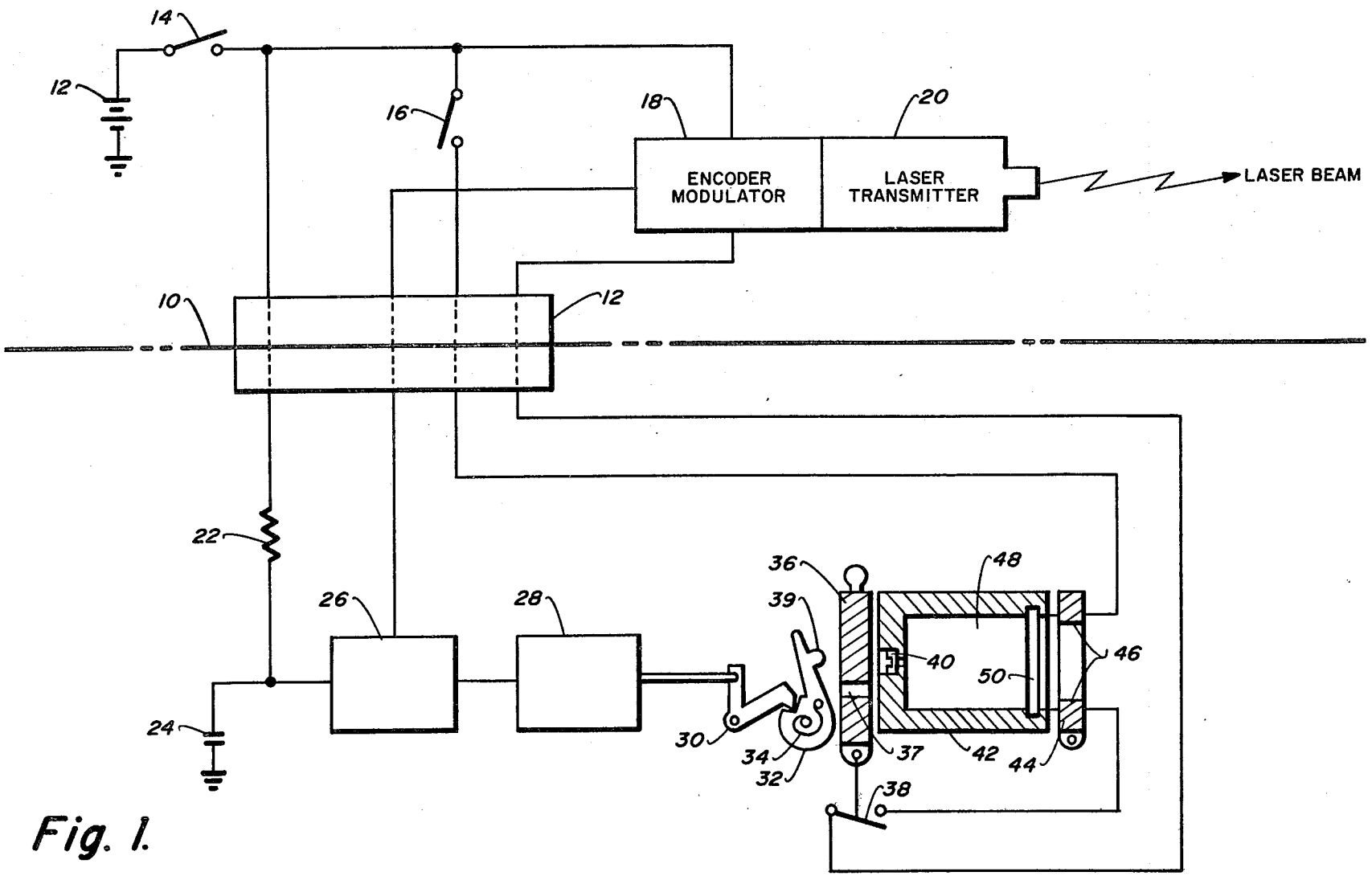

Referring now to FIG. 1, there is shown a functional block diagram of a battlefield training device utilizing the audio-visual effects simulator of the invention. Line 10 indicates the division between the weapon simulator and the audio-visual effects simulator. A connection between the two functional systems is made through connector 12. Basic components of the battlefield training device (MILES Transmitter) are shown as a battery 12, power on switch 14, trigger switch 16, an encoder-modulator 18, which, when energized, controls and actuates a laser transmitter 20. The audio-visual effects simulator consists of a resistor 22, a capacitor 24, firing circuit 26, solenoid 28, sear 30, hammer 32 and hammer spring 34, a safe-arm slide bar 36 which is linked to a safety switch 38, a firing pin 40, firing chamber 42, and a breech door 44 which supports cartridge contacts 46. The pyrotechnic cartridge 48 containing a conductive blowout disc 50 is also a component of the audio-visual effects simulator and will be discussed further in connection with FIG. 2.

Functional operation of the audio-visual effects simulator is initiated when an unexpended pyrotechnic cartridge 48 with an intact conductive blowout disc 50 is placed in firing chamber 42. Closure of the breech door 44 causes completion of an electrical circuit pathway from connector 12 to safety switch 38 through cartridge contacts 46 and conductive blowout disc 50. Preparation for firing is continued by closure of the power on switch 14 which allows current from the battery to flow through a set of contacts in connector 12 and resistor 22 to charge capacitor 24. Closure of the power on switch 14 also applies electrical power to one contact of the normally open trigger switch 16 and to the encoder-modulator 18 of the weapon simulator. The final step in preparing the mechanism for firing is to physically move the safe-arm slide bar 36 to the "arm" position. This action aligns a hole 37 in the slide bar such that a projection 39 on the hammer 32 when the hammer is released, may pass through the slide bar and strike the firing pin 40. Moving the slide bar to the "arm" position also closes safety switch 38 to complete the electrical firing circuit from the trigger switch 16 to the encoder-modulator 18. Electrical circuits within the encoder-modulator are arranged so that the firing circuit is continued through the encoder-modulator to firing circuit 26 if the weapon simulator is prepared to fire.

Figure 4:
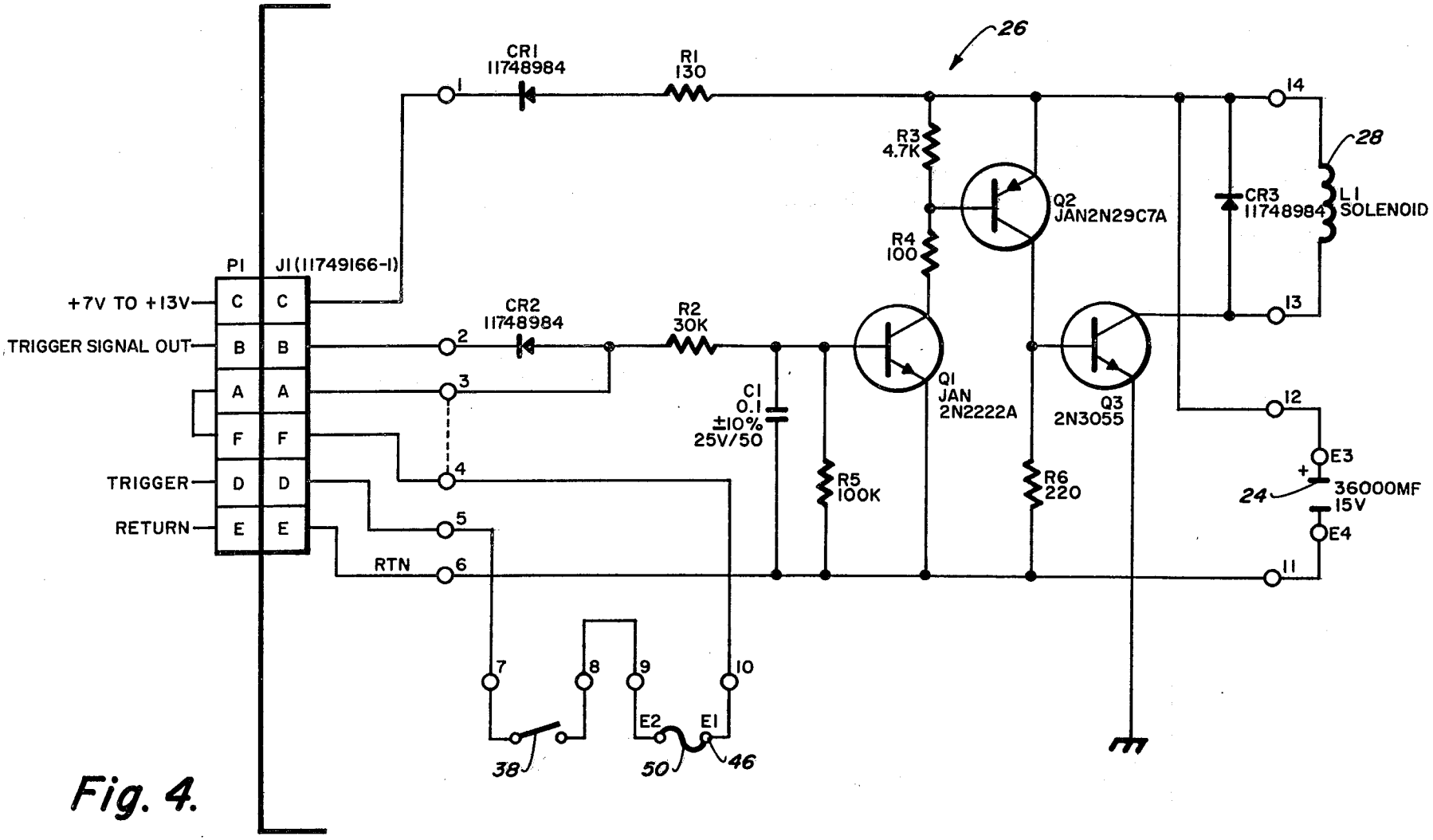

Referring now to FIGS. 1 and 4, firing the audio-visual effects simulator is accomplished by closing the trigger switch 16. This action completes the electrical circuit from the battery 12 through the cartridge contacts 46 and conductive blowout disc 50, the safety switch 38, the encoder-modulator 18 to firing circuit 26. Energizing this circuit causes Q3 of firing circuit 26 to conduct allowing the stored electrical energy in capacitor 24 to energize solenoid 28. When energized, solenoid 38 moves sear 30 thereby releasing hammer 32. Spring 34 causes the hammer 32 to rotate clockwise such that a portion of the hammer passes through the hole in the safe-arm slide bar 36 and strikes firing pin 40. Firing pin 40 in turn strikes a percussion primer (shown in FIG. 2) in pyrotechnic cartridge 48 which initiates combustion in the cartridge. The rapid rise of pressure in the cartridge causes the conductive blowout disc 50 to rupture, destroying the electrical continuity of the firing circuit, thereby opening relay 26 and permitting capacitor 24 to recharge. Not shown in FIG. 1 is a breech door linkage which recocks the hammer 32 and sear 30 and which retracts the safe-arm slide bar 36 when the breech door 44 is opened to replace an expended cartridge.

Figure 2:
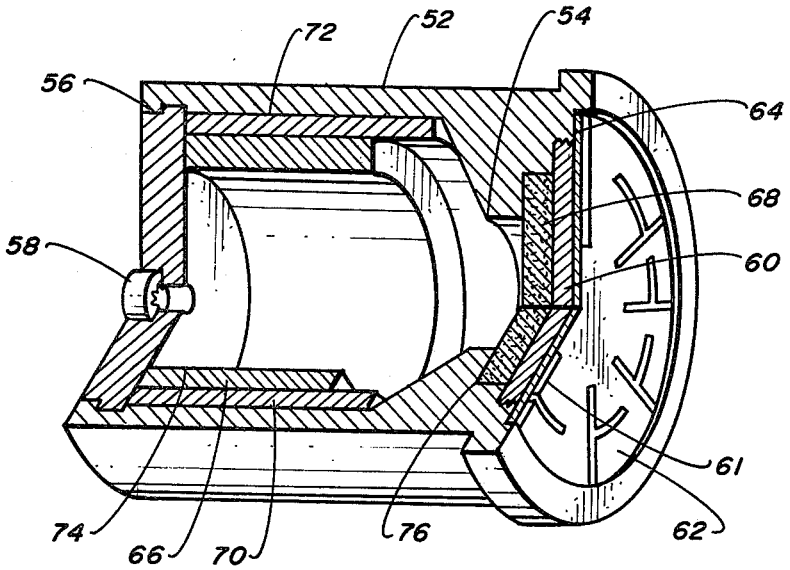

FIG. 2 shows the pyrotechnic cartridge which is used to actually produce the smoke, flash and sound simulating the desired missile launching. The cartridge is comprised of a case 52 which is fabricated of a suitable plastic compound (e.e., glass-filled ABS). The case is formed with two chambers separated by a nozzle throat 54. One end of the case is closed with an end plate 56 into which is pressed a percussion primer 58. The other end of the case is closed with a closure disc 60 having a circumferential projection which snaps into an internal circumferential groove in the case, and a contact disc 62 secured to the case and closure disc with a sealant-adhesive compound 64. End plate 56 and closure disc 60 are fabricated of suitable plastic. All parts joints are sealed against moisture with a sealant. Contact disc 62 is fabricated of non-conductive plastic to which a thin layer of conductive metal (e.g., copper) has been laminated. The metal layer is cut or etched away in selected regions so that electrical conduction across any diameter is disrupted when and if the contact disc is fractured by internal pressure from within the cartridge. (The contact disc 62 bonded to the closure disc 60 provides the function of the conductive blowout disc 50 shown in FIG. 1.)

In the two chambers of the case are placed a smoke compound pellet 66 and a flash-report compound 68. The smoke compound is a relatively slow burning chemical mixture; e.g., magnesium powder and polytetraflourethane, mixed to produce a specific amount of smoke at a specific chamber pressure which is regulated by the dimensions of the chamber and the size of the nozzle throat. The compound is pressed into a self-supporting tubular pellet which is installed inside a tubular insulator 70 (typically, cardboard) and secured with a non-combustible adhesive 72. The interior wall of the tubular smoke compound pellet is further coated with an ignition compound 74. The flash-report compound 68 fills the outer chamber of the case and is separated from the inner chamber by a charge separator disc 76. The charge separator disc is a thin sheet of metal, typically aluminum and serves only to prevent particles of the flash-report compound from falling into the inner chamber. The flash-report is a fast-burning chemical mixture which is compounded primarily to evolve gas and glowing particulate residue when burned. A typical mixture is a loose powder combination of finely ground magnesium and polytetraflourethane. The closure disc 60 has a circumferential shear groove 61 on its outer face. The depth of this groove determines the pressure at which the center diameter of the closure disc 60 will separate at the shear groove. The pressure at which the center diameter separates determines the sound level of the cartridge activation. The three audio-visual effects of the cartridge (report, flash, smoke) are all controllable within the configuration of the cartridge.

Functioning of the cartridge is initiated when the percussion primer 58 is struck by the hammer 52 (FIG. 1) of the firing mechanism. The shock sensitive explosive and booster charge in the primer produces a shock wave, hot gas, and particulate stream which travels through nozzle throat 54 penetrating the charge separator disc 76 and igniting the flash-report compound 68 and the smoke pellet 66. Burning of the flash-report compound results in a rapid evolution of gas and pressure buildup within the chamber which ruptures the contact disc 62 and causes the center portion of the closure disc 60 to shear at the radial shear groove 61 and to pop out of the cartridge. The pressure level at which this action occurs and the resultant rapid release of pressure is the source of the sound produced, and the amount of sound is adjusted by the appropriate adjustment of the force (pressure) level at which the closure disc releases. When the closure disc releases the internal pressure, the continuing evolution and expansion of gas by the flash-report compound carries with it the glowing particulate residue which produces the visual flash desired.

The report is controlled by the chemical composition and quantity of the flash-report compound 68 the composition of the closure disc 60 and the depth of the shear groove 61 in the closure disc 60.

The flash size, intensity and duration is controlled by the chemical composition, quantity and packing factor of the flash-report compound 68.

The smoke intensity and duration is controlled by the chemical composition, binder, volume of pellet, and exposed surface area of the pellet 66.

In the embodiment disclosed, the cartidge is a compromise between the signatures of several anti-tank and anti-aircraft weapons used by the U.S. Government.

Figure 3:
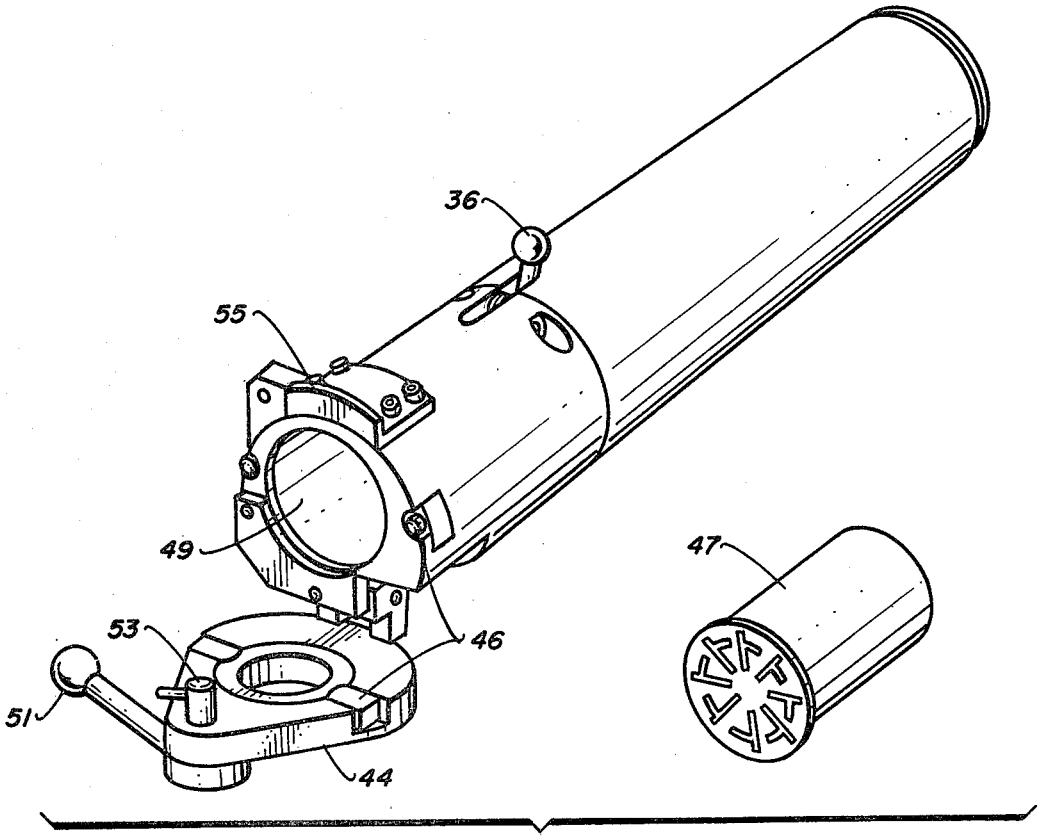

The perspective view of FIG. 3 is the assembled apparatus and shows the breech door 44 in the opened position. The cartridge 47 is received in the cartridge chamber 49. Even when the cartridge 47 has been inserted into the cartridge chamber 49 and secured by means of door lock leaver 51 and locking members 53 and 55, the device will not fire until safe-arm leaver 36 is moved to the armed position as shown and described in FIG. 1.

Obviously many modifications and variations of the present invention are possible in the light of the above teachings. It is therefore to be understood that within the scope of the appended claims the invention may be practiced otherwise than as specifically described.

We claim:

1. In a weapons effect signature simulator for use with a weapons engagement simulator, said signature simulator comprising:

a means for responding to the simulated firing of a rocket propelled weapon; means providing a report, flash and smoke associated with the actual firing of a weapon; means to determine if said signature simulator is correctly loaded; and means to inhibit the firing of said weapons simulator when incorrectly loaded.

2. The simulator of claim 1 wherein said responsive means includes a pyrotechnic cartridge.

3. The simulator of claim 1 wherein said responsive means is a dual chambered pyrotechnic cartridge.

4. The simulator of claim 3 wherein said cartridge includes means to inhibit the firing of said weapons engagement simulator unless said signature simulator is correctly loaded and armed.

5. The signature simulator of claim 3 wherein the chambers of said dual chambered cartridge are separated by a diaphram.

6. The signature simulator of claim 5 wherein one of said chambers contains a flash and report compound and the other of said chambers contains a smoke generating compound.

7. An apparatus for the audio-visual simulation of a man launched rocket propelled weapon comprising:

a pyrotechnic cartridge for providing a report, flash and smoke associated with the actual firing of a weapon, a firing chamber for receiving said cartridge, said firing chamber having a breech block positioned at the muzzle end of said chamber, said breech block having a hole therein of a smaller diameter than said cartridge to permit the efflux of the products of combustion when said cartridge is fired while retaining said cartridge; means to determine if said signature simulator is correctly loaded; and means to inhibit the firing of said weapons simulator when incorrectly loaded.

* * * * *